US006313792B1

(12) United States Patent
Merlet et al.

(10) Patent No.: US 6,313,792 B1
(45) Date of Patent: Nov. 6, 2001

(54) OPTICAL CONTROL DEVICE FOR ELECTRONIC SCANNING ANTENNA

(75) Inventors: Thomas Merlet, St Cyr l'Ecole; Olivier Maas, Gif S/Yvette; Daniel Dolfi, Orsay, all of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/457,376

(22) Filed: Dec. 9, 1999

(51) Int. Cl.[7] ..... H01Q 3/22
(52) U.S. Cl. ..... 342/371; 342/375
(58) Field of Search ..... 342/368, 371, 342/372, 375

(56) References Cited

U.S. PATENT DOCUMENTS

| | | | | |
|---|---|---|---|---|
| 5,231,405 | * | 7/1993 | Riza | 342/375 |
| 5,235,463 | | 8/1993 | Broussoux et al. . | |
| 5,298,740 | | 3/1994 | Ayral et al. . | |
| 5,307,073 | | 4/1994 | Riza . | |
| 5,307,306 | | 4/1994 | Tournois et al. . | |
| 5,428,697 | | 6/1995 | Dolfi et al. . | |
| 5,430,454 | | 7/1995 | Refregier et al. . | |
| 5,475,525 | | 12/1995 | Tournois et al. . | |
| 5,936,484 | | 8/1999 | Dolfi et al. . | |
| 6,031,201 | * | 2/2000 | Amako et al. | 219/121.68 |

FOREIGN PATENT DOCUMENTS 0 708 491 4/1996 (EP) .

OTHER PUBLICATIONS

N.A. Riza, et al., Applied Optics, vol. 36, No. 5, pp. 983–996, "Phased–Array Antenna, Maximum–Compression, Reversible Photonic Beam Former with Ternary Designs and Multiple Wavelengths," Feb. 10, 1997.

* cited by examiner

*Primary Examiner*—Dao Phan
(74) *Attorney, Agent, or Firm*—Oblon, Spivak, McClelland, Maier & Neustadt, P.C.

(57) ABSTRACT

An optical control device for an electronic scanning antenna having at least two controlled radiating elements, and including means for providing first and second mixed light beams, the first light beam polarized according to a first direction and having a first wavelength ($\lambda_1$), and the second light beam, polarized according to a second direction and having a second wavelength ($\lambda_2$); at least two optical delay circuits each receiving the first and second mixed light beams and configured to induce complementary delays compared to a determined time value on the first and second beams; chromatic separators each situated at the output of a corresponding one of the delay circuits and configured to separate the light having the first wavelength ($\lambda_1$) from the light having the second wavelength ($\lambda_2$); first photodetectors each coupling a corresponding radiating element to a corresponding chromatic separator; second photodetectors each coupling a corresponding chromatic separator to a corresponding first mixer; and second mixers each of which is coupled to a corresponding first mixer, a corresponding radiating element, and a radar signal processor. The first and second light beams are modulated at a transmission frequency ($f_e$) and each of the first mixers mixes the modulated transmission frequency ($f_e$) and an intermediate frequency ($f_i$) to provide a local oscillator frequency ($f_{OL}$) at an output of the first mixer, and the second mixer mixes the local oscillator frequency ($f_{OL}$) and a received signal from a corresponding radiating element including the transmission frequency ($f_e$) and a Doppler frequency ($f_D$) to provide an output frequency which comprises the intermediate frequency augmented by the Doppler frequency ($f_i$+$f_D$) to the radar signal processor.

10 Claims, 4 Drawing Sheets

OPTICAL CONTROL DEVICE FOR ELECTRONIC SCANNING ANTENNA

CROSS-REFERENCE TO RELATED APPLICATIONS

This application relates to French Patent Application 98-07240 incorporated by reference herein.

BACKGROUND OF THE INVENTION

1. Field of the Invention

This invention regards an optical control device for broadband radar transmission and reception. It is applicable to the control of broadband electronic scanning antennas to ensure both the formation of a beam for transmission and the reception of a beam reflected by a target.

2. Discussion of the Background

An electric scanning antenna comprises many radiating elements that ensure both the transmission and the reception of an ultrahigh frequency signal. A transmission or reception beam is formed by all the signals transmitted or received by each element. To orient a beam in a given direction θ, it is necessary to create time delays between signals transmitted or received by the various radiating elements. To obtain an analogous effect, it is known how to create a phase delay between these signals. The phase difference $\phi 1-\phi 2$ between the signals transmitted or received by two radiating elements is given by the following equation:

$$\Phi_1 - \Phi_2 = \frac{d\sin\theta}{c} \times 2\pi f \tag{1}$$

where d represents the distance between the two radiating elements, f represents the frequency of the signals and c represents the speed of the light, the time delay created being $$T_1 - T_2 = \frac{d\sin\theta}{c}.$$

The phase difference $\phi 1-\phi 2$ is equal to $2\pi f(T_1-T_2)$.

The preceding equation (1) highlights a major disadvantage residing in the fact that the phase difference depends on the frequency. Consequently, if the frequency varies, the sighting angle varies as well. This method for orienting a beam is therefore not suited to broadband radar. However ultrahigh frequency techniques do not allow us to create a time delay between the signals other than through the creation of the preceding phase difference, except to implement a device that is prohibitive from a size and cost standpoint. Effectively, a theoretically simpler solution would be to create a delay directly between the signals supplied to the different radiating elements, but that would require cumbersome and costly ultrahigh frequency circuits, due more particularly to the unavoidable dimensions imposed by the wavelengths in question.

The use of optical techniques allows us to overcome the aforementioned disadvantage by controlling the radiating elements directly through time delays, without requiring the artifice of phase differences, these delays being created in the optical domain. To that effect, optical control solutions for electronic scanning antennas have already been implemented. With regard to transmission, numerous optical control architectures have already been proposed in order to control the radiation pattern during transmission. An example of optical architecture is given in French patent No. 90 03386.

With regard to reception, beam formation using time delays requires a very significant dynamic of all the delays, still inaccessible to the optical components. A direct architecture based on the bi-directional operation of the control developed for transmission therefore does not seem possible in the short- or intermediate-term. To mitigate this disadvantage, a correlation architecture was defined in particular in accordance with the description of French patent No. 94 11498. However, this type of architecture is restricted to radars with a small bandwidth, typically 10 MHz.

SUMMARY OF THE INVENTION

The disadvantage of a correlation architecture stems particularly from the fact that the use of complementary delays is incompatible with local oscillator signal frequencies and remote transmission signal frequencies, for example 500 MHz, which characterize broadband radar. This frequency difference is unavoidable for the proper operation of a radar system, particularly in order to avoid problems linked to aliasing.

One goal of the invention is more particularly to allow an architecture of the aforementioned type to function for a radar with a large bandwidth. To this end, the aim of the invention is an optical control device for electronic scanning antenna comprising radiating elements for controlling this device comprising a set of optical circuits for creating delays, each receiving a first light beam, polarized according to a first direction and having a first wavelength, this first beam being affected by an appropriate delay; and a second light beam, polarized according to a second direction, with a second wavelength. Each optical delay circuit induces complementary delays with respect to a determined time value on the light of the first and second beams that it receives, a chromatic separator is situated at the output of each delay circuit and separates the light with the first wavelength from the light with the second wavelength, and each radiating element of the antenna is coupled to the output of a delay circuit by a first photodetector. As the two beams are modulated at the transmission frequency, for each receiving signal of a radiating element, the local oscillator is supplied at the output of a first ultrahigh frequency mixer by mixing the transmission frequency and an intermediate frequency, then the frequency of the receiving signal supplied to the radar processing means, at an intermediate frequency augmented by the Doppler frequency of the signal received, is obtained at the output of a second ultrahigh frequency mixer by mixing the local oscillator frequency with the frequency of the signal received.

In an embodiment variation of a device according to the invention, as the two beams are modulated at the transmission frequency, for each receiving signal of a radiating element the local oscillator frequency is supplied at the output of a photo-mixer by mixing the frequency of the signal received carried by the optical wave and an intermediate frequency, then the frequency of the receiving signal supplied to the radar processing means, at an intermediate frequency augmented by the Doppler frequency of the signal received, is obtained at the output of an ultrahigh frequency mixer by mixing the local oscillator frequency with the transmission frequency.

The main advantages of the invention are that the invention makes it possible to avoid the transposition of the receiving signal on an optical carrier, while benefiting from the broadband processing offered by a time-delay architecture, and that it is simple to implement.

BRIEF DESCRIPTION OF THE DRAWINGS

Other features and advantages of the invention will become clear in connection with the description that follows given in relation to the appended drawings, which represent.

DETAILED DESCRIPTION OF THE PREFERRED EMBODIMENT

Figure 1:
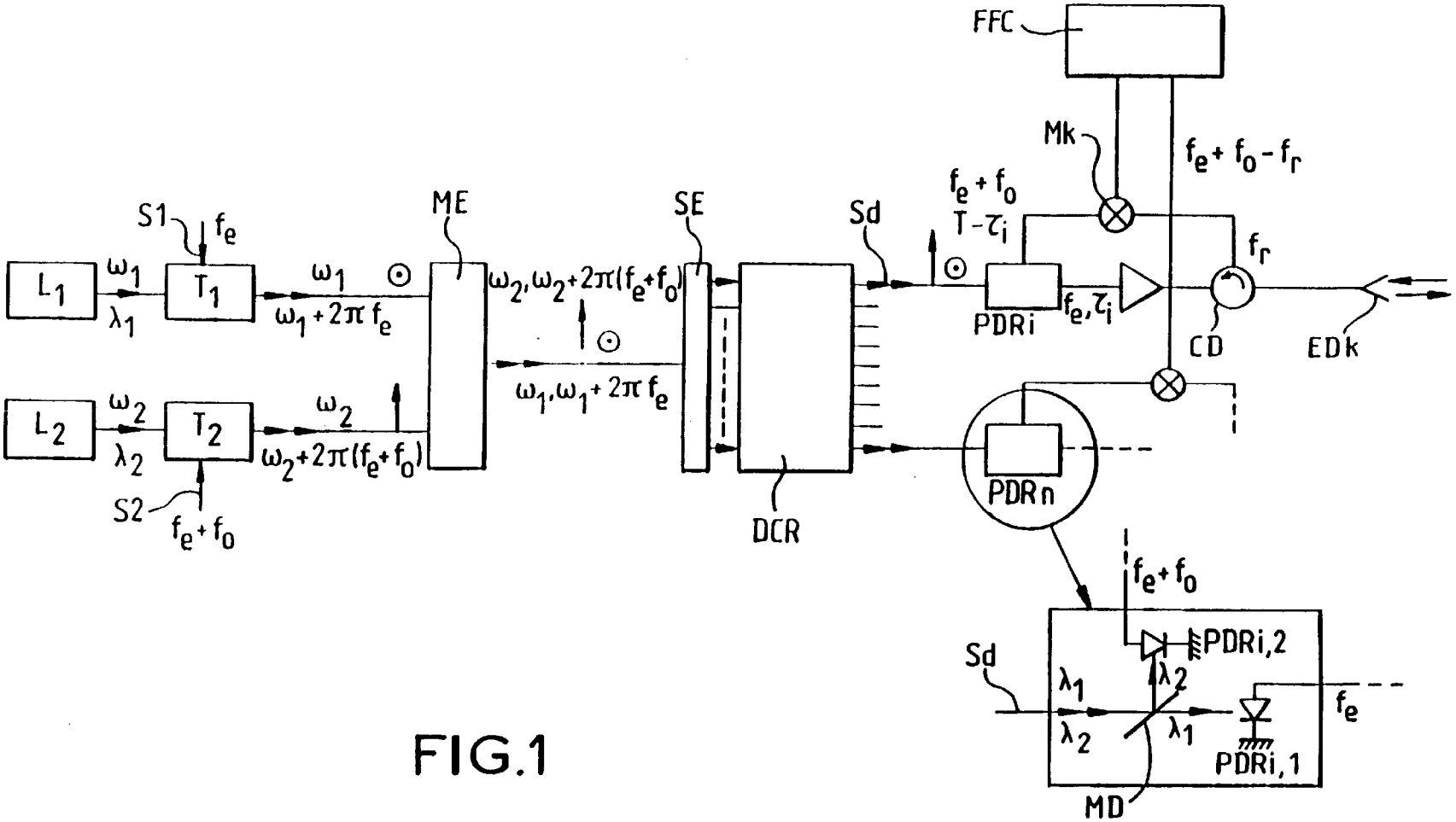
FIG. 1, is a block diagram of a correlation optical control device.

FIG. 1 is an optical control device that functions for transmission and reception of the type, for example, described by French patent No. 94 11498. The signals emanating from the device are used for transmission, the supply of active modules or radiating elements and, for reception and for the generation of a local oscillator adapted in frequency and direction.

In this system, the light from beams F1, F2 is modulated in frequency. A first source L1 emits a single frequency light beam F1 with a wavelength $\lambda 1$ (pulsation $\omega 1$ ). A translator at frequency T1 receives this light and transmits light at $\omega 1$ and light at $\omega 1+2\pi fe$ modulated using a signal at frequency fe. The translator at frequency T1 is, for example, a Bragg acoustical-optical cell for frequencies roughly less than or equal to 5 GHz or an integrated optical device for higher frequencies.

A second light source transmits another single frequency light beam F2 with a wavelength $\lambda 2$ (pulsation $\omega 2$). A T2 frequency translator receives this light and transmits light at $\omega 2$ and light at $\omega 2+2\pi(fe+fo)$ modulated by a signal at frequency fe+fo.

In one application for controlling an electronic scanning antenna, the frequency fe is situated in the range of ultrahigh frequencies and corresponds to the transmission frequency of the antenna. The frequency fo is substituted for a local oscillator frequency for the antenna's receiving mode in the remainder of the description.

The light transmitted by the translator T1 is polarized according to a determined direction. The light transmitted by the translator T2 is polarized according to a direction perpendicular to that transmitted by T1.

An optical mixer system ME superimposes the light emanating from translator T1 onto that from translator T2. The resulting beam therefore comprises light polarized according to two orthogonal directions, as symbolized in FIG. 1, and at two different frequencies emanating from translators T1 and T2.

The resulting beam is stretched by a beam separator SE so that it is distributed over the different inputs of a set of delay circuits DCR.

This set of delay circuits DCR can, for example, be embodied like the set described in French patent No. 92 34 467.

Each delay circuit delays the light from source L1 and the light from source L2 differently. More precisely, according to an example of an embodiment, if T is the maximum delay induced by a delay circuit, the light from source L1 is delayed by a time ti and the light from source L2 is delayed by a time T−ti complementary to time T. The times T of the various delay circuits are equal, for example.

For example, the delay circuits DCR comprise a set of spatial light modulators comprising p×p pixels (same number of pixels as antenna radiating elements) and allow one to control the phase difference and the delay assigned to each of the p×p channels thus cut out. The delay circuits DCR supply delays in geometric progression so that N spatial modulators suffice to obtain 2N distinct delay values for each of the p×p channels of the architecture. Switching of delays is based on controlled rotation, owing to the spatial light modulators, of the polarization of the beams. In order to obtain a local oscillator that is directionally adapted, one exploits the property of the DCR, which is to generate, on each channel, complementary delays for combined input polarization states. Effectively, if the beam emanating from L1 undergoes a delay in channel i, then the beam emanating from L2 undergoes a delay T−ti,T being the transit time of the DCR.

Each Sd output of a delay circuit supplies light with a wavelength $\lambda 1$ modulated at the frequency fe and light with a wavelength $\lambda 2$ modulated at the frequency fe+fo.

Detection circuits PDRi and PDRn are connected to the Sd outputs, for example by optical fibers. These circuits are, for example, embodied as represented at the bottom right of FIG. 1. Each circuit comprises a chromatic separator MD that separates the light with a wavelength $\lambda 1$ from the light with a wavelength $\lambda 2$.

The light with a wavelength $\lambda 1$ is transmitted to a photodetector PDRi,l, which transmits a photocurrent at frequency fe toward a radiating element ED1.

This photocurrent results from the interference between the light at $\omega 1$ and the light at $\omega 1+2\pi fe$.

The photocurrent transmitted is amplified by an amplifier so as to be compatible with the radiated power necessary for the transmission of the radiating element of the radar.

By allowing for suitable delays in the various delay circuits, one controls the antenna's radiation pattern. The antenna's transmission orientation is thus controlled optically.

Additionally, the light with a wavelength $\lambda 2$ is transmitted to another photodetector PDRi,2 by the chromatic separator. This separator transmits a photocurrent resulting from the interference between the light at $\omega 2$ and $\omega 2+2\pi(fe+fo)$. This photocurrent is applied to an ultrahigh frequency mixer Mk that also receives a signal received by an antenna element. It should be noted that a directional coupler CD permits, on the one hand, the coupling of the photocurrent of PDRi,1 to an antenna element in the direction of transmission and, on the other hand, the coupling of a detection current from an antenna element (in the direction of reception) to the frequency mixer Mk.

All the signals emanating from the photodetectors PDRi,2 in fact make up a local oscillator (homodyne or heterodyne) adapted to the antenna's direction of transmission.

Thus, the signal received by an antenna element EDk is amplified and applied jointly with the signal from PDRk2 to an ultrahigh frequency mixer Mk. In effect, if the signal transmitted by the antenna element EDk has the form $S(t-\tau k)$, the same element receives a signal $R(t'+\tau k)$, which must therefore be mixed with a local oscillator $S'(t'+T+\tau k)$.

The low frequency signals from the mixers are processed according to two possibilities:

digitization at the level of each antenna element and summation of all these signals in a standard digital processor for fine beam formation through the FFC calculation. This processor may also be remote with respect to the receiving antenna by means of a reduced number of wavelength division multiplexed digital fiber optic links.

excitation of the p×p pixels of a bidimensional spatial light modulator using these low frequency p×p signals to implement coherent optical processing of the reverse channel.

Figure 2:
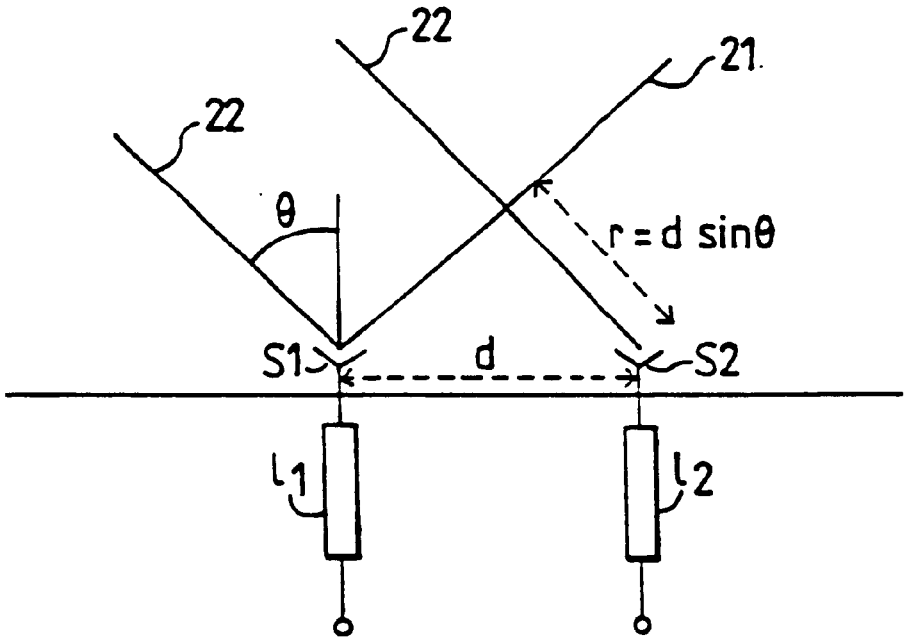
FIG. 2, is a schematic illustration of an antenna configuration with, by way of example, two radiating elements.

With regard to the needs of a radar system, and assuming a system with two radiating elements powered by connections of variable lengths that introduce delays, one arrives for transmission at a configuration such as the one illustrated by FIG. 2. By way of example, this figure presents a system made up of two radiating elements $S_1$ and $S_2$ separated by a distance d and powered by variable delays $l_1$ and $l_2$. An angle θ represents the sighting angle or boresight angle of the beam. A plane 21, perpendicular to the boresight angle 22 referenced as θ represents an equiphase plane, that is, a plane in which all the signals have the same phase. For both signals from the elements $S_1$ and $S_2$ to radiate in phase in the direction θ, the delays must have the following relation:

$$l_1 - l_2 = \frac{d\sin\theta}{c} \tag{2}$$

In a direct architecture, the receiving signals are transposed on an optical carrier. Since the system is reciprocal, the condition for the delays to be introduced to capture a wave in the direction θ is, in this case, strictly identical.

Figure 3:
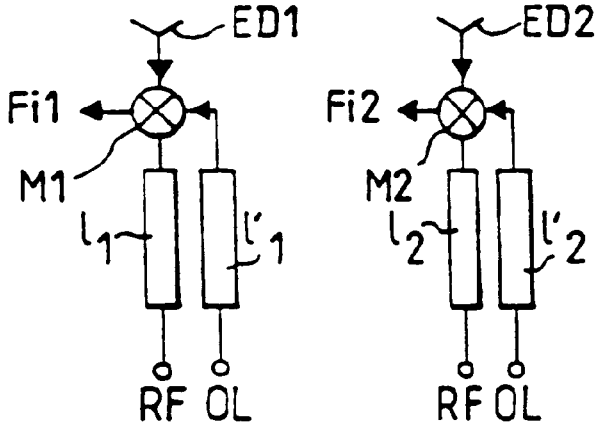
FIG. 3, is a schematic illustration of a part of a correlation optical control example, showing mixers introduced behind each radiating element.

In a correlation architecture of the type shown in FIG. 1, mixers are introduced behind each radiating element as illustrated in FIG. 3. The mixers M1 and M2 situated behind each radiating element receive the signal to be received and the OL signal from the local oscillator having experienced a delay $l_1'$ and $l_2'$. The intermediate frequency signals Fi1 and Fi2 result from mixing the signal received at the transmission frequency RF and the signal OL of the local oscillator. This mixture is expressed by subtracting the frequencies and the phases of the signals. The phases ψ(Fi1) and ψ(Fi2) of the intermediate frequency signals Fi1 and Fi2 confirm the following equations:

$$\varphi(Fi1) = -\left[(\omega_{RF} - \omega_{OL})t + \Phi_{r1} + \frac{\omega_{OL}}{c}\right]l_1' \tag{3}$$

$$\varphi(Fi2) = -\left[(\omega_{RF} - \omega_{OL})t + \Phi_{r2} + \frac{\omega_{OL}}{c}\right]l_2' \tag{4}$$

where $\omega_{RF}$ and $\omega_{OL}$ represent respectively the pulsations of the receiving signals and of the local oscillator, and c represents the speed of the light.

Phases $\phi_{r1}$ and $\phi_{r2}$ represent the phases received on the dipoles.

For the wave coming from the direction θ to be received and summed, it is necessary that these phases confirm the following equation:

$$\Phi_{r2} = \Phi_{r1} - \frac{d\sin\theta}{c}\omega_{RF} \tag{5}$$

The following equation results:

$$\omega_{OL}(l_2'-l_1') = \omega_{RF}(l_1-l_2) \tag{6}$$

By applying complementary delays to the receiving and $\omega_{RF}$ pulsation signals and to the signals from the local oscillator $\omega_{OL}$, the paths of travel confirm that $l_1+l_1'=L$, L being a constant length and i being equal to 1 or 2, or more when the system comprises more than two radiating elements, as is generally the case. In particular, $l_1+l_1'=l_2+l_2'$. Then, according to the equation (6):

$$(l_1 - l_2) = \frac{\omega_{OL}}{\omega_{RF}}(l_1 - l_2) \tag{7}$$

It therefore appears that the condition of operation is verified only if the pulsations $\omega_{RF}$ and $\omega_{OL}$ are relatively close to one another.

Now, in the receiving mode of a standard radar system, the frequency of the local oscillator is chosen outside of the agility band of the radar system in order, more particularly, to avoid problems linked to aliasing. Consequently, the use of this type of architecture in receiving mode is restricted to radar systems with narrow bandwidths, for example approximately 10 MHz. It therefore appears necessary to make modifications to the operation, particularly of an architecture of the type shown in FIG. 1, so as to retain the broadband property for architectures with optical control using time delays.

One disadvantage of the correlation architecture therefore stems from the fact that the use of complementary delays is incompatible with frequencies $f_o$ and $f_e$ of the local oscillator and transmission signals, usually separated by 500 MHz for broadband radar. This frequency difference between the local oscillator and the transmission or receiving signal is necessary for the proper operation of the radar system in order to avoid problems linked to aliasing as indicated above.

Figure 4:
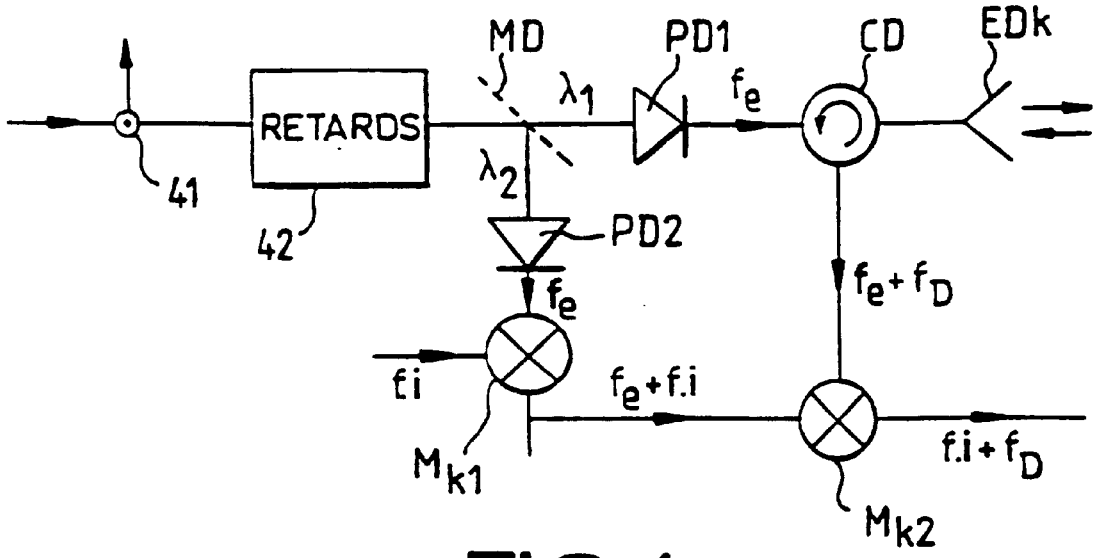
FIG. 4, is a block diagram of an example of a possible architecture present in a device according to the invention.

To mitigate the aforementioned disadvantage, according to the invention, complementary delays are imprinted on the same frequency $f_e$, the transmission frequency, then the local oscillator OL with frequency $f_{OL}$ is formed by mixing the transmission frequency with an intermediate frequency $f_i$ produced, for example, by a frequency generator common to all the channels. In this case, the two beams F1 and F2 are both modulated at the same frequency $f_e$, which is the transmission frequency. This dual mixing solution is illustrated by FIG. 4. This figure shows the circuits coupled with a radiating element EDk, of order k. The light polarized (41) at the output of the optical mixer ME undergoes a delay (42) by passing, for example, through the beam separator SE and the delay circuit DCR as illustrated by FIG. 1. The direct and complementary delays are imprinted on the same frequency $f_e$. To this end, a chromatic separator MD is situated at the output of the delay elements 42, more particularly on each of the outputs of the delay circuit DCR. This separator MD separates the light with wavelength $\lambda_1$ from the light with wavelength $\lambda_2$. The light with wavelength $\lambda_1$ is transmitted to a first photodetector PD1 that transmits a photocurrent with the transmission frequency $f_e$ toward the radiating element EDk. A directional coupler CD is incorporated between this first photodetector PD1 and the radiating element EDk.

The light with wavelength $\lambda_2$ is transmitted to a second photodetector PD2 that transmits a photocurrent with the transmission frequency $f_e$ toward an input of a first ultrahigh frequency mixer Mk1. The other input of this mixer receives the aforementioned intermediate frequency $f_i$. The output of the first mixer Mk1 gives a frequency signal $f_e+f_i$. This signal acts as the local oscillator signal, the aforementioned frequency $f_{OL}$ being equal to $f_e+f_i$. The output of the first mixer Mk1 is connected to the input of a second mixer Mk2, which therefore receives the frequency signal $f_e+f_i$. The other input of the second mixer Mk2 is connected to an output of the directional coupler CD, in the knowledge that one of its inputs is connected to the output of the first photodetector PD1 and that the other input/output is connected to the radiating element ED1. This directional coupler therefore allows one, on the one hand, to couple, in the direction of transmission, the photocurrent created by the first photodetector PD1 to the radiating element EDk, and, on the other hand, to couple, in the direction of reception, the radiating element EDk with the second mixer Mk2. The receiving signal supplied to this second mixer Mk2, via the directional coupler CD, has a frequency equal to that of the transmission frequency $f_e$ augmented by a Doppler frequency $f_D$. The receiving signal that enters the second mixer therefore has a frequency equal to $f_e+f_D$. The output signal from the second mixer consequently has a frequency equal to $f_i+f_D$, i.e., a frequency equal to the sum of the intermediate frequency and the Doppler frequency. In other words, one thus recovers at the output of the second mixer a signal at the intermediate frequency offset by the Doppler frequency. This signal is then processed by standard processing means for radar operations.

Figure 5:
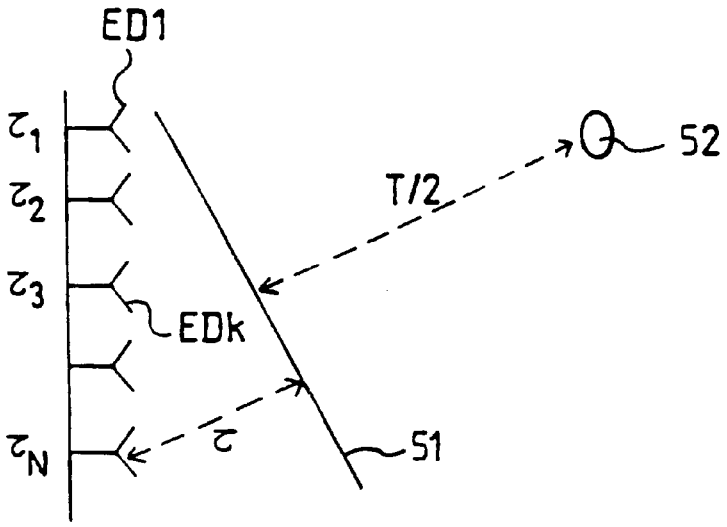
FIG. 5, is a schematic illustration of the delays applied to the radiating elements and of the wave thus transmitted toward a target.

FIG. 5 shows an equiphase plane 51 of a wave transmitted from radiating elements EDk directed toward a target 52. Each radiating element is affected by a delay $\tau_k$, produced in accordance with FIGS. 1 and 4. In this case, each radiating element of order k EDk transmits a signal whose phase $\phi_E(k)$ is defined by the following equation:

$$\phi_E(k)=2\pi f_e(t-\tau_k) \tag{8}$$

where $\tau_k$ represents the delay on the channel of the radiating element EDk. During reception, this channel receives a signal of phase $\phi_R(k)$ defined by the following equation:

$$\phi_R(k)=2\pi f_r(t-T-\tau+\tau_k) \tag{9}$$

where the receiving frequency $f_r=f_e+f_D$, $f_D$ being the Doppler offset frequency cited previously. The value T represents the round trip time for a signal transmitted to the target 53, more particularly for a signal transmitted from a first group of radiating elements ED1, as illustrated in FIG. 5.

The phases $\phi_{OL}$, formed on the complementary channels are defined by the following equation:

$$\phi_{OL}(k)=2\pi f_e(t-\tau+\tau_k) \tag{10}$$

The inclined local oscillator is obtained, at the output of the first mixer Mk1, by mixing the complementary channels with an intermediate frequency $f_i$ with a pure phase $\phi_{fi}=2\pi(f_i)t$. The inclined local oscillator phase $\phi_{OL}'$ is therefore given by the following equation:

$$\phi_{OL}'(k)=2\pi(f_e f_i)t-2\pi f_e(\tau-\tau_k) \tag{11}$$

The second term $2\pi f_e(\tau-\tau_k)$ of the equation (11) represents a phase gradient at the transmission frequency, which causes this phase to follow an inclination law according to the transmission frequency $f_e$.

By once again mixing the inclined local oscillator signal with the signal received by means of the second mixer, a signal around the intermediate signal is obtained whose phase $\phi_{fi}(k)$ satisfies the following equation:

$$\phi_{fi}(k)=2\pi(f_i+f_D)t+2\pi f_D(\tau-\tau_k)+2\pi(f_e+f_D)T \tag{12}$$

Considering the order of values in question, where notably $f_D$ is approximately $10^3$ Hz and where $\tau$ and $\tau_k$ are approximately $10^{-8}$ sec., the term $f_D(\tau-\tau_k)$ is negligible. The signals on the different channels coupled with the various radiating elements EDk can therefore be summed in phase since there are no more terms that depend on the delays $\tau_k$. The signal thus formed on a channel has a phase $\phi_{signal}$ defined as follows:

$$\phi_{signal}(k)=2\pi(f_i+f_D)t+2\pi(f_e+f_D)T \tag{13}$$

The first term of the equation (13) $2\pi(f_1+f_D)$ provides information about the speed of the target and the second term $2\pi(f_e+f_D)T$, which is constant compared to the time t, provides information concerning the distance of the target, more specifically by calculation of the value T from which the distance is deduced. The equation (13) therefore shows that the signals from the various radiating elements EDk can be summed in phase without limiting the bandwidth. The very broadband property permitted by optical control is thus retained for reception.

In an optical control device with a correlation architecture, the dynamic constraint on the optical links is replaced by a stability constraint on the stability signal of the local oscillator. A dual mixture architecture according to the invention makes it possible to avoid the transposition of the receiving signal on an optical carrier while taking advantage of the broadband processing offered by an optical architecture with time delays.

Figure 6:
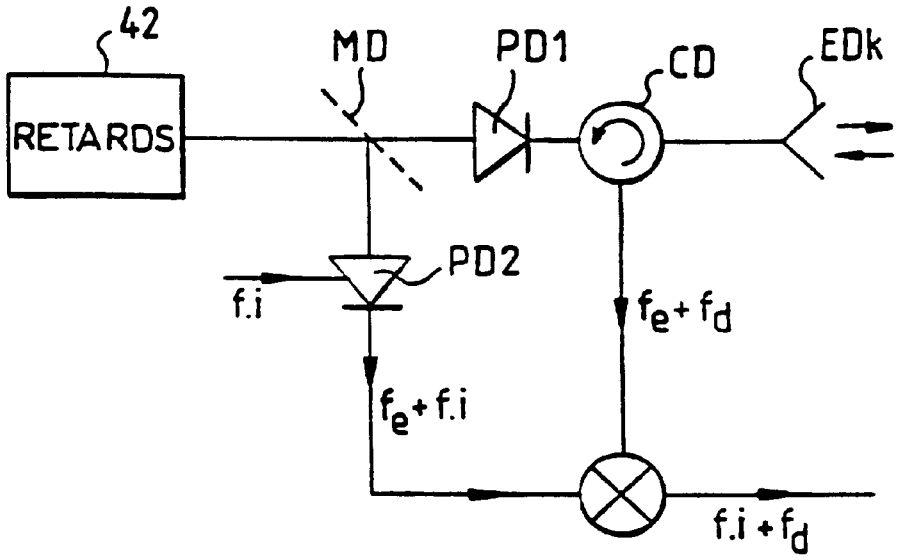
FIGS. 6 and 7, are block diagram of other possible examples of embodiment of a device according to the invention.

FIG. 6 shows an embodiment variation of a device according to the invention. To economize one mixer per antenna element, for example, the first mixture is, for example, accomplished by the second photodetector PD2. Therefore in this case, this detector serves as both photodetector and ultrahigh frequency mixer. In this way, the number of mixers is reduced by half for all of the antenna.

In another embodiment variation, generation of the complementary delays necessary for the inclined local oscillator can also be obtained by doubling the number of pixels of the delay circuit DCR. In this case, p×p pixels are, for example, assigned to generate signals to be transmitted and other p×p pixels are each used to generate the local oscillator assigned to each radiating element. This embodiment variation has the advantage of greater flexibility of use. More particularly, it allows one to obtain different transmission and reception patterns. The delay law applied to the local oscillator is totally independent of the law applied to the signal transmitted. If $\tau_k^e$ and $\tau_j^3$ represent the delays applied to the transmission respectively in channel k and channel j on the one hand, and if $\tau_k^{OL}$ and $\tau_j^{OL}$ represent the delays applied respectively to channel k and to channel j of the local oscillator on the other hand, then the construction of a suitable local oscillator is accomplished for a given frequency $f_e$ of the band of the radar system by producing the following equation:

$$(\tau_k^{OL}-\tau_j^{OL})f_{OL}=(\tau_k^e-\tau_j^e)f_e \tag{14}$$

where $f_e$ and $f_{OL}$ represent the frequencies of the local oscillator and of the transmission signal.

Figure 7:
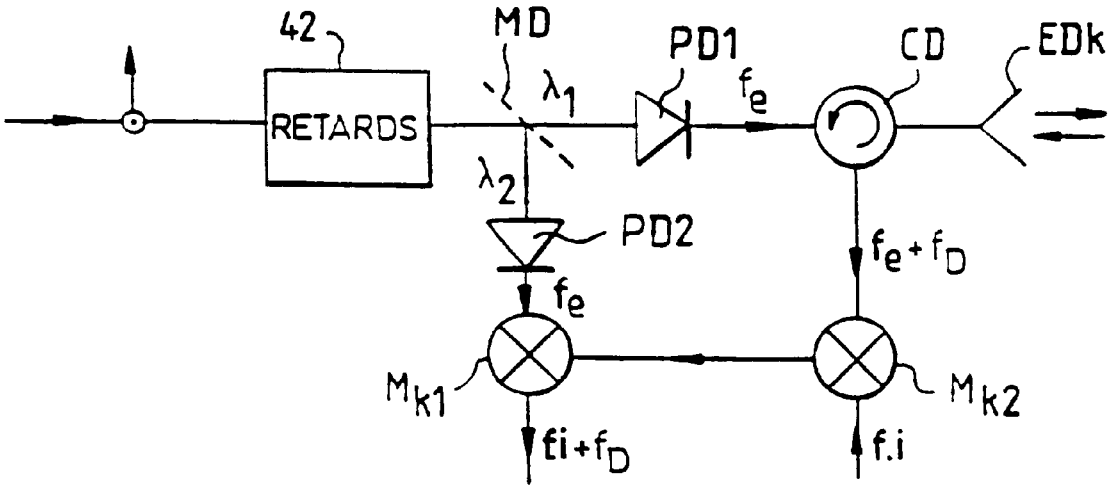

FIG. 7 shows a third variation of embodiment for a device according to the invention. In this variation, the functions of both mixers Mk1 and Mk2 are inverted The intermediate frequency signal $f_l$ is mixed with the receiving signal at frequency $f_e+f_D$ by the second mixer Mk2 to form a local oscillator signal received at the output of this second mixer. This local oscillator signal received is then mixed with the local oscillator transmission signal, whose frequency is, in fact, the transmission frequency $f_e$, by the first mixer Mk1. This second mix gives a signal with frequency $f_l+f_D$, i.e., an intermediate frequency augmented by the Doppler frequency of the signal received. This second mix may also be accomplished directly by the second photodetector PD2 in accordance with the first variation presented in relation to FIG. 6.

Numerous modifications and variations are possible in light of the above teachings. It is therefore to be understood that within the scope of the appended claims, the present invention may be practiced other than as specifically described herein.

What is claimed as new and desired to be secured by Letters Patent of the United States is:

1. Optical control device for an electronic scanning antenna having at least two controlled radiating elements, comprising:

means for providing first and second mixed light beams, said first light beam polarized according to a first direction and having a first wavelength ($\lambda_1$), and said second light beam, polarized according to a second direction and having a second wavelength ($\lambda_2$);

means for modulating said first and second light beams at a transmission frequency of the antenna;

a plurality of optical delay circuits each receiving mixed first and second light beams and configured to induce complementary delays compared to a determined time value on said first and second beams;

a plurality of chromatic separators each situated at an output of a corresponding one of said delay circuits and configured to separate the light having the first wavelength ($\lambda_1$) from the light having the second wavelength ($\lambda_2$);

a plurality of first photodetectors each coupling a corresponding radiating element to a corresponding chromatic separator;

a plurality of second photodetectors each coupling a corresponding chromatic separator to a corresponding first mixer; and plurality of second mixers each of which is coupled to a corresponding first mixer, a corresponding radiating elements, and a radar signal processor;

wherein said first and second light beams are modulated at a transmission frequency ($f_e$) and each of said first mixers mixes the modulated transmission frequency ($f_e$) and an intermediated frequency ($f_i$) to provide a local oscillator frequency ($f_{OL}$) at an output of the first mixer, and said second mixer mixes said local oscillator frequency ($f_{OL}$) and a received signal from a corresponding radiating element including said transmission frequency ($f_e$) and a Doppler frequency ($f_D$) to provide an output frequency which comprises said intermediate frequency augmented by said Doppler frequency ($f_i$+$f_D$) to the radar signal processor.

2. The device as claimed in claim 1, further comprising:

a plurality directional couplers each of which is incorporated between one of said first photodetectors and a corresponding radiating element;

wherein the light having the first wavelength ($\lambda_1$) is transmitted from each of said chromatic separators to a corresponding first photodetector which transmits a photocurrent at the transmission frequency ($f_e$) to a corresponding radiating element, the light having the second wavelength ($\lambda_2$) is transmitted from each of said chromatic separators to a corresponding second photodetector which transmits a photocurrent at the transmission frequency ($f_e$) to an input of a corresponding first frequency mixer which also receives as another input an intermediate frequency ($f_i$), the output signal of the first mixer serving as a local oscillator signal and being connected to the input of a corresponding second mixer which also receives from the directional coupler the signal received by the radiating element, the output of the second frequency mixers being a signal whose frequency is the sum of the intermediate frequency ($f_i$) and the Doppler frequency ($f_D$) of the signal received.

3. The device as claimed in claim 1, wherein each of the second photodetectors is also the corresponding first frequency mixer.

4. The device as claimed in claim 1, wherein the antenna comprises p×p radiating elements and the delay circuits include spatial light modulators comprising first p×p pixels configured to generate signals to be transmitted and second p×p pixels each used for the generation of the local oscillator assigned to each radiating element.

5. The device as claimed in claim 1, wherein the values $\tau_k^e$ and $\tau_j^e$ represent the delays applied to the transmission respectively in a channel k, coupled with a radiating element of order k and in a channel j, coupled with a radiating element of order j, and $\tau_k^{OL}$ and $\tau_j^{OL}$ represent the delays applied respectively to channel k and channel j of the local oscillator, and wherein the frequency $f_{OL}$ verifies the following equation:

$$(\tau_k^{OL}-\tau_j^{OL})f_{OL}=(\tau_k^e-\tau_j^e)f_e$$

where $f_e$ represents the frequency of the transmission signal.

6. Optical control device for an electronic scanning antenna having at least two controlled radiating elements, comprising:

means for providing first and second mixed light beams, said first light beam polarized according to a first direction and having a first wavelength ($\lambda_1$), and said second light beam, polarized according to a second direction and having a second wavelength ($\lambda_2$);

means for modulating said first and second light beams at a transmission frequency of the antenna;

a plurality of optical delay circuits each receiving mixed first and second light beams and configured to induce complementary delays compared to a determined time value on said first and second beams;

a plurality of chromatic separators each situated at an output of a corresponding one of said delay circuits and configured to separate the light having the first wavelength ($\lambda_1$) from the light having the second wavelength ($\lambda_2$);

a plurality of first photodetectors each coupling a corresponding radiating element to a corresponding chromatic separator;

a plurality of second photodetectors each coupling a corresponding chromatic separator to a corresponding first mixer; and a plurality of second mixers each of which is coupled to a corresponding first mixer, a corresponding radiating elements, and a radar signal processor;

wherein said first and second light beams are modulated at a transmission frequency ($f_e$) and said second mixers mixes a received signal including said transmission frequency ($f_e$) and a Doppler frequency ($f_D$) from a corresponding radiating element and an intermediate frequency ($f_i$) to provide a local oscillator frequency ($f_{OL}$) at the output of the first mixer, and said first mixer mixes the modulated transmission frequency ($f_e$) and said local oscillator frequency ($f_{OL}$) to provide an output frequency which comprises said intermediate frequency augmented by said Doppler frequency to a radar signal processor.

7. The device as claimed in claim 6, further comprising:

a plurality of directional couplers each of which is incorporated between one of said first photodetectors and a corresponding radiating element;

wherein the light having the first wavelength ($\lambda_1$) is transmitted from each of said chromatic separators to a corresponding first photodetector which transmits a photocurrent at the transmission frequency ($f_e$) to a corresponding radiating element, the light having the second wavelength ($\lambda_2$) is transmitted from each of said chromatic separators to a corresponding second photodetector which transmits a photocurrent at the transmission frequency ($f_e$) to an input of a corresponding first frequency mixer which also receives as another input the local oscillator frequency and outputs a signal whose frequency is the sum of the intermediate frequency ($f_i$) and the Doppler frequency ($f_D$) of the signal received, and said second frequency mixer receives from the directional coupler the signal received by the radiating element and an intermediate frequency ($f_i$), the output signal of the second mixer serving as a local oscillator signal and being connected to the input of a corresponding first second mixer.

8. The device as claimed in claim 6, wherein each of the second photodetector is also the corresponding first frequency mixer.

9. The device as claimed in claim 6, wherein the antenna comprises p×p radiating elements and the delay circuits include spatial light modulators comprising first p×p pixels configured to generate signals to be transmitted and second p×p pixels each used for the generation of the local oscillator assigned to each radiating element.

10. The device as claimed in claim 6, wherein the values $\tau_k^e$ and $\tau_j^e$ represent the delays applied to the transmission respectively in a channel k, coupled with a radiating element of order k and in a channel j, coupled with a radiating element of order j, and $\tau_k^{OL}$ and $\tau_j^{OL}$ represent the delays applied respectively to channel k and channel j of the local oscillator, and wherein the frequency $f_{OL}$ verifies the following equation:

$$(\tau_k^{OL}-\tau_j^{OL})f_{OL}=(\tau_k^e-\tau_j^e)f_e$$

where $f_e$ represents the frequency of the transmission signal.

* * * * *